US007374440B2

(12) United States Patent
Chen et al.

(10) Patent No.: US 7,374,440 B2
(45) Date of Patent: May 20, 2008

(54) CARD CONNECTOR WITH METAL SHELL

(75) Inventors: Kun-Hua Chen, Tu-Cheng (TW); Yung-Chien Chung, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 7 days.

(21) Appl. No.: 11/444,073

(22) Filed: May 31, 2006

(65) Prior Publication Data

US 2006/0270260 A1 Nov. 30, 2006

(30) Foreign Application Priority Data

May 31, 2005 (CN) ..... 2005 1 0040369

(51) Int. Cl.
*H01R 13/20* (2006.01)

(52) U.S. Cl. ..... 439/159

(58) Field of Classification Search ..... 439/159, 439/160, 157

See application file for complete search history.

(56) References Cited

U.S. PATENT DOCUMENTS 6,478,591 B1 * 11/2002 Chang ..... 439/159
6,554,627 B1 * 4/2003 Chen ..... 439/159
6,572,392 B2 * 6/2003 Motojima ..... 439/159
6,652,301 B2 * 11/2003 Harasawa et al. ..... 439/159
6,669,494 B2 * 12/2003 Abe ..... 439/159
2006/0166532 A1 * 7/2006 Tsai ..... 439/159

* cited by examiner

*Primary Examiner*—Gary F. Paumen
(74) *Attorney, Agent, or Firm*—Wei Te Chung

(57) ABSTRACT

A card connector includes an insulating housing (10), a number of contacts (20), an ejector (30) and a metal shell (40). The insulating housing (10) defines a card receiving space (13) with a card insertion/ejecting direction. The contacts (20) are retained in the insulating housing. The ejector (30) is assembled to the insulating housing, including a slider (31) movable along the card insertion/ejecting direction, an ejecting arm (32), a resilient member (34) and a locking equipment, the ejecting arm protrudes into the card receiving space and has an upright wall (324), a blocking wall (325) for contacting and ejecting the card directly and a horizontal reinforce wall (326), which are linked with one another and defines a space to receive a corner of the card.

12 Claims, 5 Drawing Sheets

CARD CONNECTOR WITH METAL SHELL

BACKGROUND OF THE INVENTION

1. Field of the Invention

The present invention is generally related to a card connector, and especially to a card connector which is adapted for insertion/ejecting of a card.

2. Description of Related Art

Card connectors are widely used in variety electrical equipments for building electrical paths between the electrical equipments and electrical cards which are used as storage devices.

U.S. Pat. No. 6,669,494 discloses a commonly card connector adapted for receiving an electrical card comprises an insulting housing defining a receiving space, a plurality of contacts received in the insulting housing, an ejector and a metal shell covering the insulating housing. The ejector comprises a slider moveable along an insertion/ejecting direction of the electrical card, a spring for providing a resilient restorable force to eject the electrical card and a lock equipment for locking the slider and the electrical card in a final position. An ejecting arm is formed on the slider and protrudes into the receiving space for ejecting the electrical card. The ejecting arm has a first extending portion with an incline plane and a second extending portion extending from the first extending portion for directly contacting with a front end of the electrical card. Since during both an insertion and an ejecting process of the electrical card, the second extending portion always bear a counterforce from the electrical card, and the slider is made by plastic material, the linking portion where the second extending portion linking with the first extending portion is thin, the second extending portion is easily broken off from the first extending portion, that will cause the ejector to work unnormally.

Hence, an improved card connector is highly desired to overcome the aforementioned disadvantages of the prior art.

SUMMARY OF THE INVENTION

Accordingly, an object of the present invention is to provide a card connector, which is formed with an ejector with a firm ejecting arm.

To achieve the above object, a card connector is adapted for receiving a card and comprises an insulating housing defining a card receiving space with a card insertion/ejecting direction, a plurality of contacts retained in the insulating housing, an ejector received in the insulating housing and a metal shell. The ejector comprises a slider movable along the card insertion/ejecting direction, an ejecting arm protruding into the card receiving space, a resilient member urging the slider toward the ejecting direction of the card and a locking equipment. The ejecting arm has an upright wall extending along the card insertion/ejecting direction, a blocking wall for contacting with and ejecting the card directly and a horizontal reinforce wall, the upright wall, the blocking wall and the reinforce wall are linked with one another.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
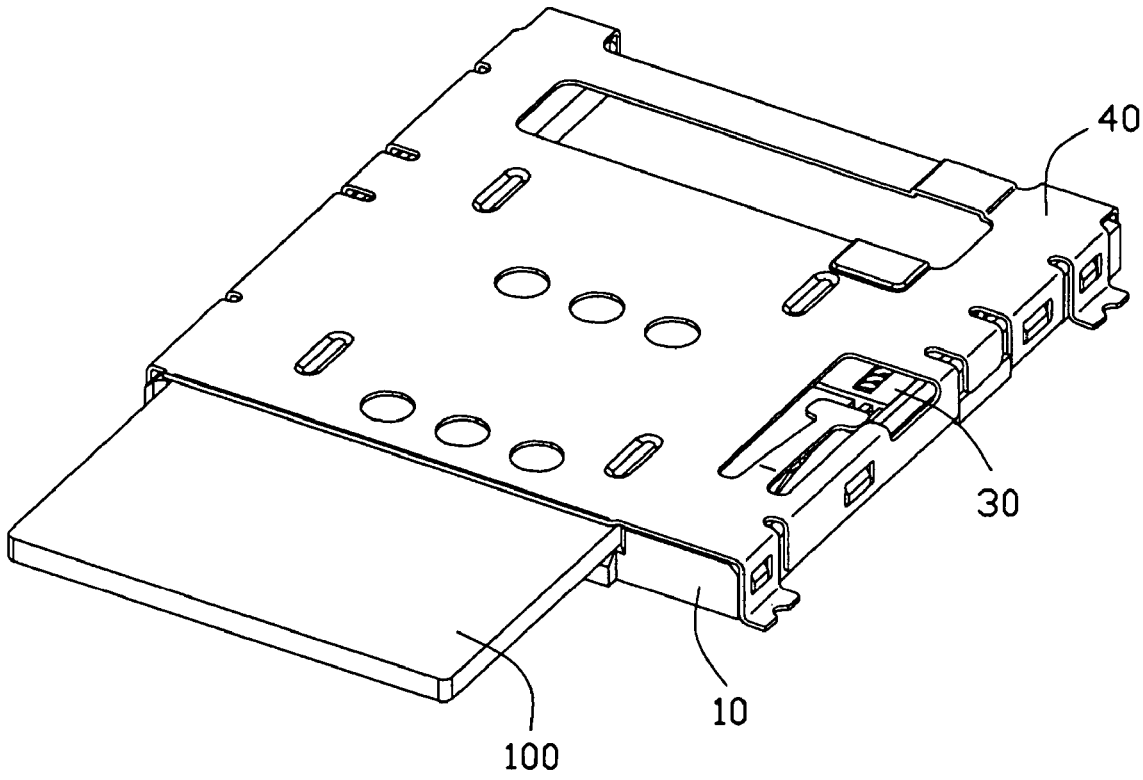
FIG. 1 is an assembled, perspective view of a card connector in accordance with the present invention with a card therein.
Figure 2:
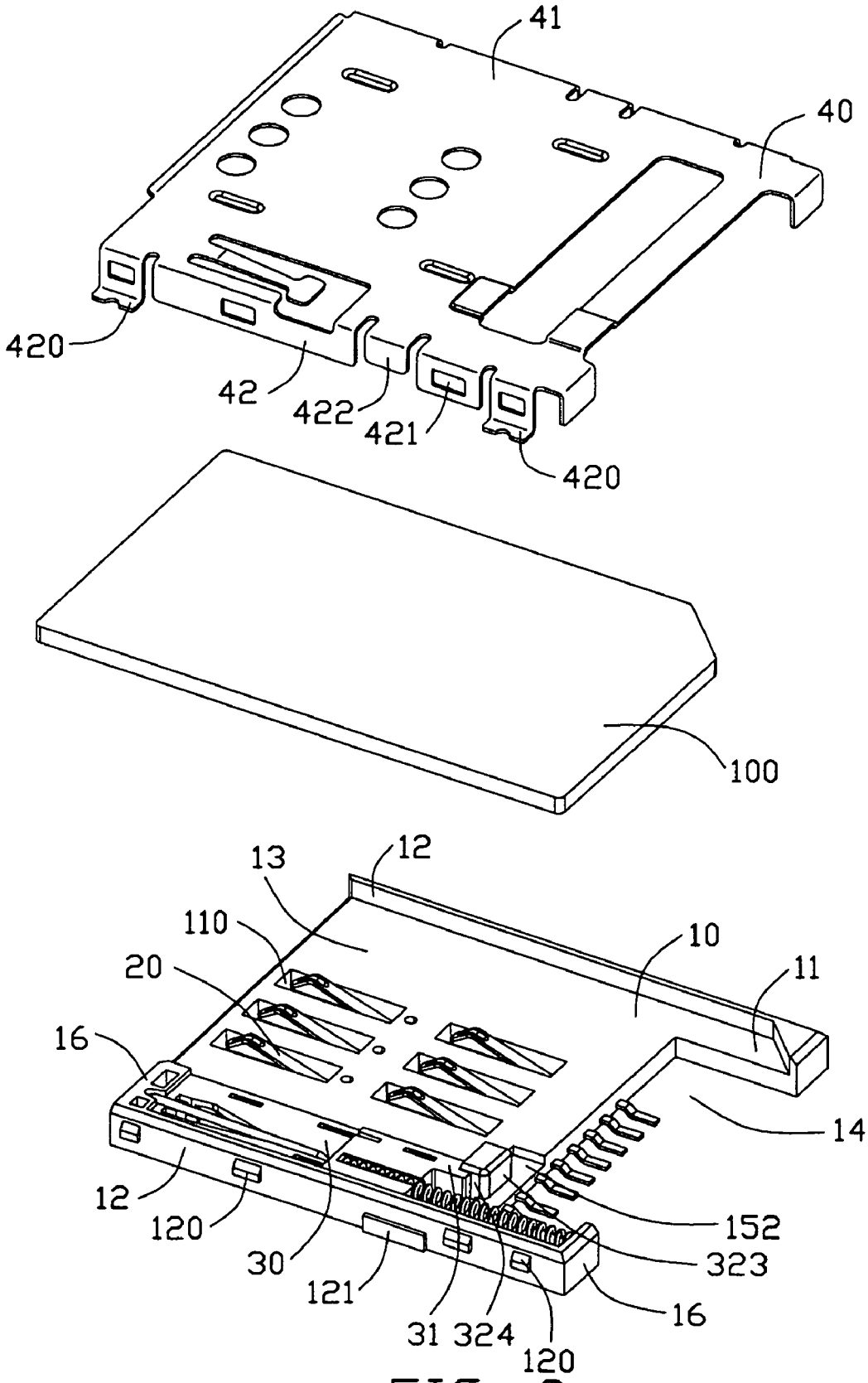
FIG. 2 is a partially assembled, perspective view of the card connector in accordance with the present invention.

Referring to FIGS. 1 and FIG. 2, the card connector in accordance with the present invention is adapted for receiving a card, such as a SIM card 100. The card connector comprises an insulating housing 10, a plurality of contacts 20 received in the insulating housing 10, an ejector 30 and a metal shell 40 covering the insulating housing 10.

Figure 3:
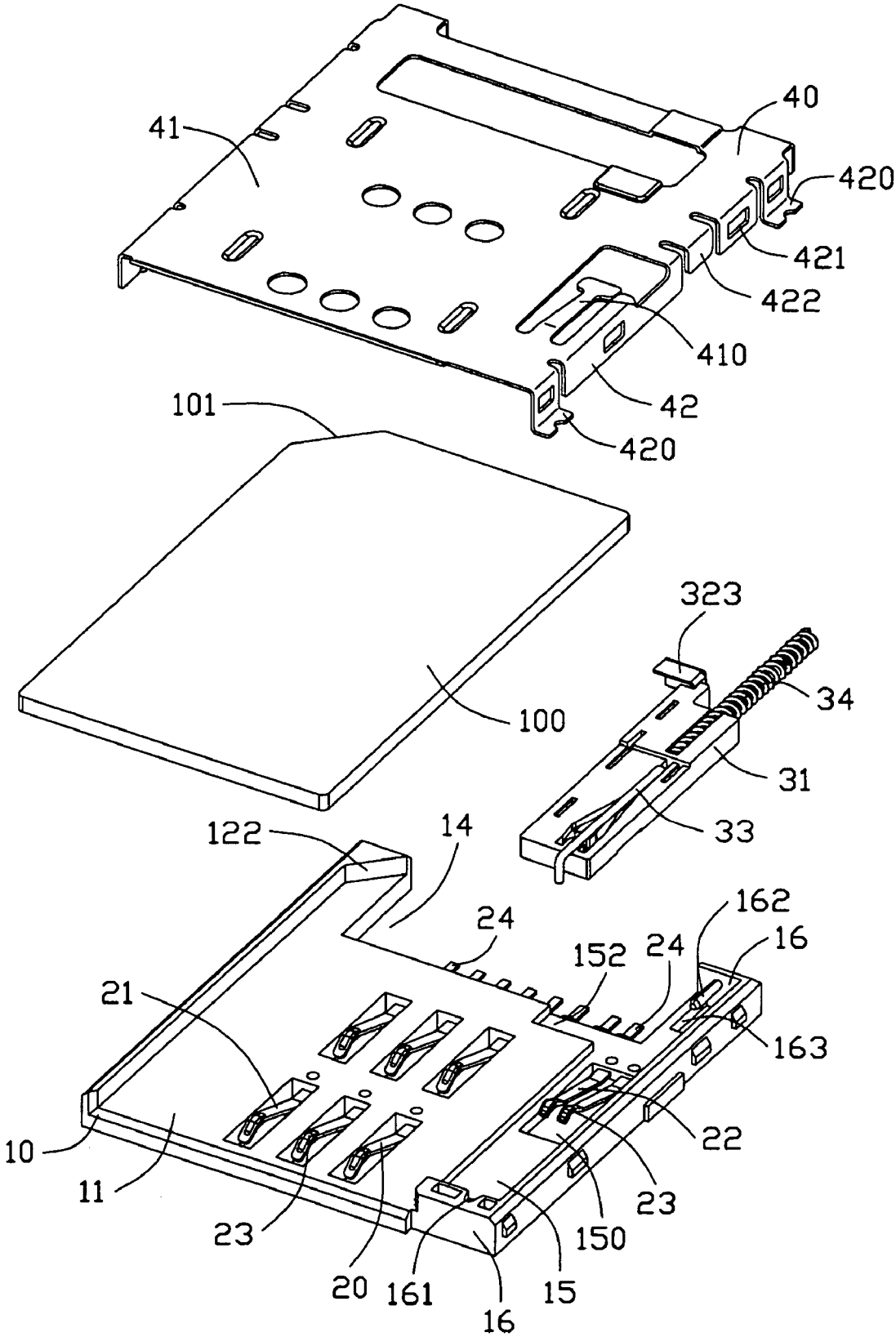
FIG. 3 is a partially exploded, perspective view of the ejector of the card connector in accordance with the present invention.

Referring to FIG. 2 and FIG. 3, the insulating housing 10 is approximately a rectangle configuration. The insulating housing 10 comprises a bottom wall 11 and a pair of opposite right and left sidewalls 12 extending upwardly from lateral sides of the bottom wall 11, which commonly define a card receiving space 13 with a card insertion/ejecting direction for the SIM card 100, together. The bottom wall 11 defines an U-shaped opening 14 at a rear edge thereof and is formed with a plurality of rectangular passages 110 arranged in two rows along the card insertion/ejecting direction. The bottom plate 11 defines a receiving recess 15 adjacent to and extending along a sidewall 12 for receiving the ejector 30. A through slot 150 is defined in a center of the receiving recess 15.

The contacts 20 which are insert-molded with the insulating housing 10 respectively, include six signal contacts 21 divided into two lines and two grounding contacts 22 arranged in a line. Each contact 20 comprises a contacting portion 23, an intermediate portion (not labeled) extending rearward from the contacting portion 23 and molded in the insulating housing 10 and a soldering portion 24 extending rearward from the intermediate portion to be soldered to a print circuit board (not shown). The contacting portions 23 of the signal contacts 21 are received in the corresponding passage 110 and exposed into the card receiving space 13 for contacting with the SIM card 100, the contacting portions 23 of the grounding contacts 22 are received in the through slot 150 and protrude from the bottom plate 11 for contacting with the ejector 30. All the soldering portions 24 extend rearward into the opening 14, and the soldering portions 24 are arranged in a line and inwardly of the rear face of the insulating housing 10 to save space on the print circuit board (not shown) for assembling on the card connector.

Referring to FIG. 2 and FIG. 3, the receiving recess 15 is extending along the card insertion/ejecting direction for accommodating the ejector 30, the right sidewall 12 of the insulating housing 10 is formed with a pair of front and rear walls 16 at front and rear ends of the receiving recess 15. The bottom wall 11 defines a groove 152 adjacent to the opening 14 and transversely communicating with a rear end of the receiving recess 15. A downwardly recessed hole 161 is formed on the front wall 16, a column 162 protrudes forwardly from the rear wall 16 in alignment with the column 162 along the card insertion/ejecting direction and is exposed into the receiving recess 15, a gap 163 is defined on the receiving recess 15 under the column 162 and downwardly through the receiving recess 15.

Figure 4:
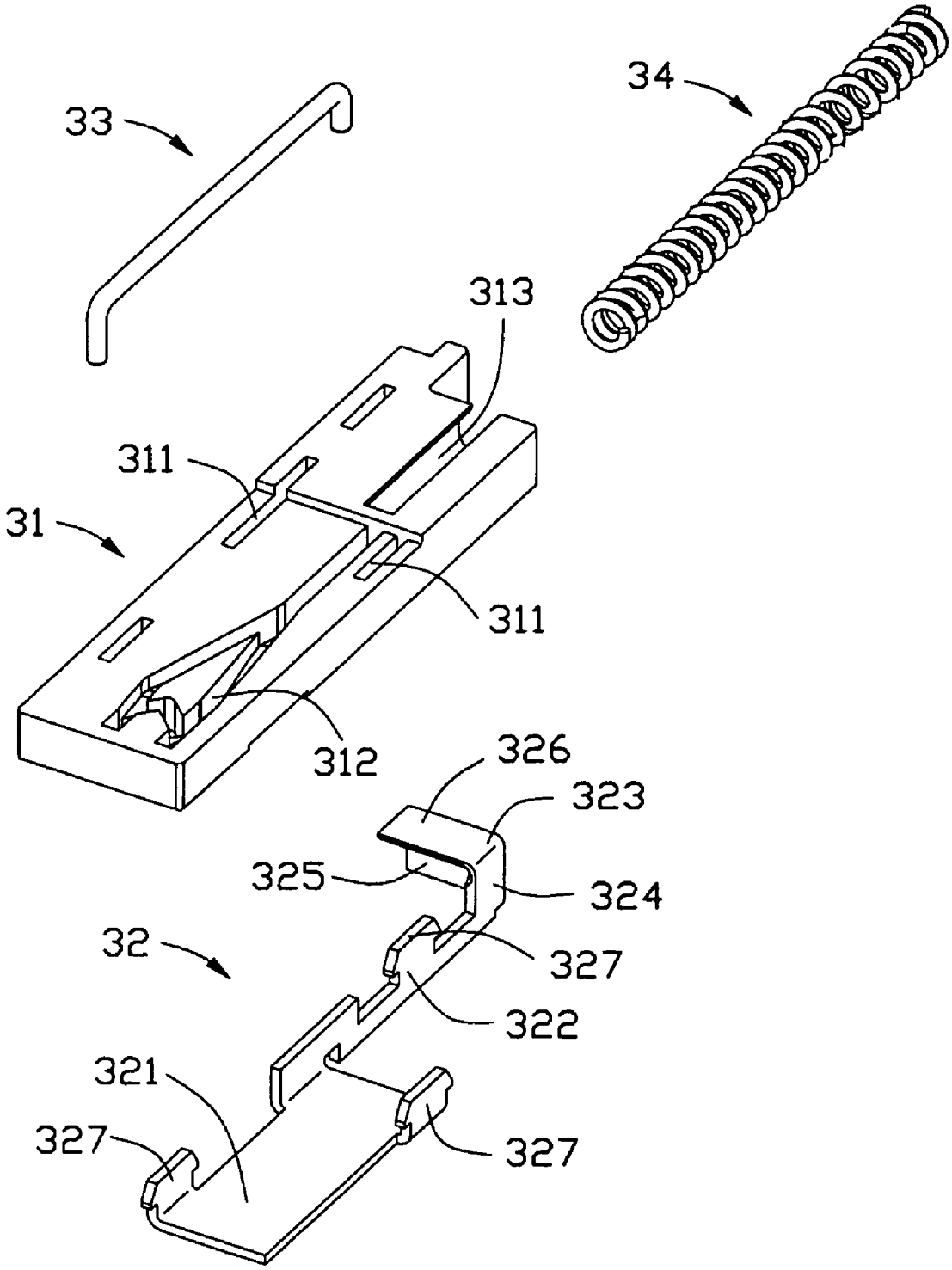
FIG. 4 is an exploded, perspective view of the ejector of the card connector in accordance with the present invention.

Referring to FIGS. 2-4, the ejector 30 is used for ejecting the SIM card 100 out of the card connector and received in the receiving recess 15. The ejector 30 comprises a slider 31, an ejecting arm 32 for contacting and ejecting the SIM card 100 directly, a pin member 33 and a resilient member for urging the slider 31 toward the ejecting direction of the SIM card 100, in this embodiment, the resilient member is a spring 34. The ejecting arm 32 is a separate component, however, the ejecting arm 32 also can be unitary with the slider 31 on condition that the ejecting arm 32 can protrude into the card receiving space 13 to eject the SIM card 100.

The slider 31 is approximately an elongated cube configuration and movably received in the receiving recess 15 of the insulating housing 10 to be movable along the card insertion/ejecting direction. The slider 31 defines a plurality of retaining slots 311 recessed downwardly from a top face through a bottom face of lateral sides thereof, a heart-shaped slot 312 recessed downwardly from a top face thereof and a semi-circular receiving hole 313 recessed forwardly from a rear face thereof.

The ejecting arm 32 is stamped from a metal sheet and comprises a horizontal plate 321, an upright holding arm 322 extending upward and rearward from a rear end of inner side of the horizontal plate 321 adjacent to the card receiving space 13 and an operating portion 323 on a rear end of the holding arm 322 extending into the card receiving space 13. A plurality of hooks 327 protrudes upwardly from the holding arm 322 and lateral sides of the horizontal plate 321, respectively. The ejecting arm 32 is securely assembled to the slider 31 from a bottom face of the slider 31, with the hooks 327 interferencely received in the retaining slots 311 of the slider 31.

The operating portion 323 transversely protrudes into the card receiving space 13 and locates in the groove 152 of the bottom wall 11 to contact and eject the SIM card 100. The operating portion 323 has a frame figure comprising an upright wall 324 extending along the insertion/ejecting direction of the SIM card 100, a blocking wall 325 for contacting with and ejecting the SIM card 100 directly and a horizontal reinforce wall 326. The upright wall 324, the blocking wall 325 and the reinforce wall 326 are linking with each other to define a half exoteric space for receiving a rear corner of the SIM card 100 adjacent to the ejector 30, together.

The spring 34 has two ends, one end disposed around the column 162 of the rear wall 16 and the other end received in the receiving hole 313 of the slider 31. The pin member 33 is in a U-shaped with two ends, one end moveably disposed in the heart-shaped slot 312 of the slider 31 and the other end securely locked in the hole 161 of the insulating housing 10. The pin member 33 and the heart-shaped slot 312 are referred as a locking equipment, which can hold the slider 31 and the SIM card 100 in a final position where the SIM card 100 is electrically connected with the card connector, and can release the slider 31 when ejecting the SIM card 100.

referring to FIG. 2 and FIG. 3, the metal shell 40 is stamped from a metal sheet and covers the insulating housing 10. The metal shell 40 comprises a top plate 41 and a pair of opposite right and left side portions 42. The top plate 41 is formed with a resilient piece 410 for pressing downwardly against the pin member 33 toward the heart-shaped slot 312 of the slider 31. Each side portion 42 is formed with a pair of soldering feet 420 on opposite distal ends along the card insertion direction for being mounted on the printed circuit board (not shown). Each side portion 42 also provides a plurality of mating holes 421 and an engaging piece 422, the insulating housing 10 is correspondly formed with a plurality of wedges 120 and a protruding block 121 in each sidewall 12 to mate with the mating holes 421 and the engaging piece 422, respectively. Thus, The metal shell 40 is securely assembled to the insulating housing 10.

referring to FIG. 3, the SIM card 100 is formed with a plurality of electrical pads (not shown) for contacting with the signal contact 21 and a cutout 101 in a corner between a rear end and a left side thereof. The left sidewall 12 of the insulating housing 10 is formed with a slanting face 122 faced to the card receiving space 13 at a rear end thereof to recognize the cutout 101 for preventing the SIM card 100 from mismating. In process of the SIM card 100 inserting into the card connector, a rear end of a right side of the SIM card 100 pushes the slider 31 to move along the card insertion direction and to urge the spring 34 to elastically distort. In the meantime, the pin member 33 moves along the heart-shaped slot 312 of the ejector 30 to make the slider 31 finally stop at the final position or a locking position where the SIM card 100 is electrically connected with the contacts 20 accurately and fully. In addition, the grounding contacts 22 are electrically connected with the horizontal plate 321 of the ejecting arm 32 of the ejector 30 to discharge static.

Figure 5:
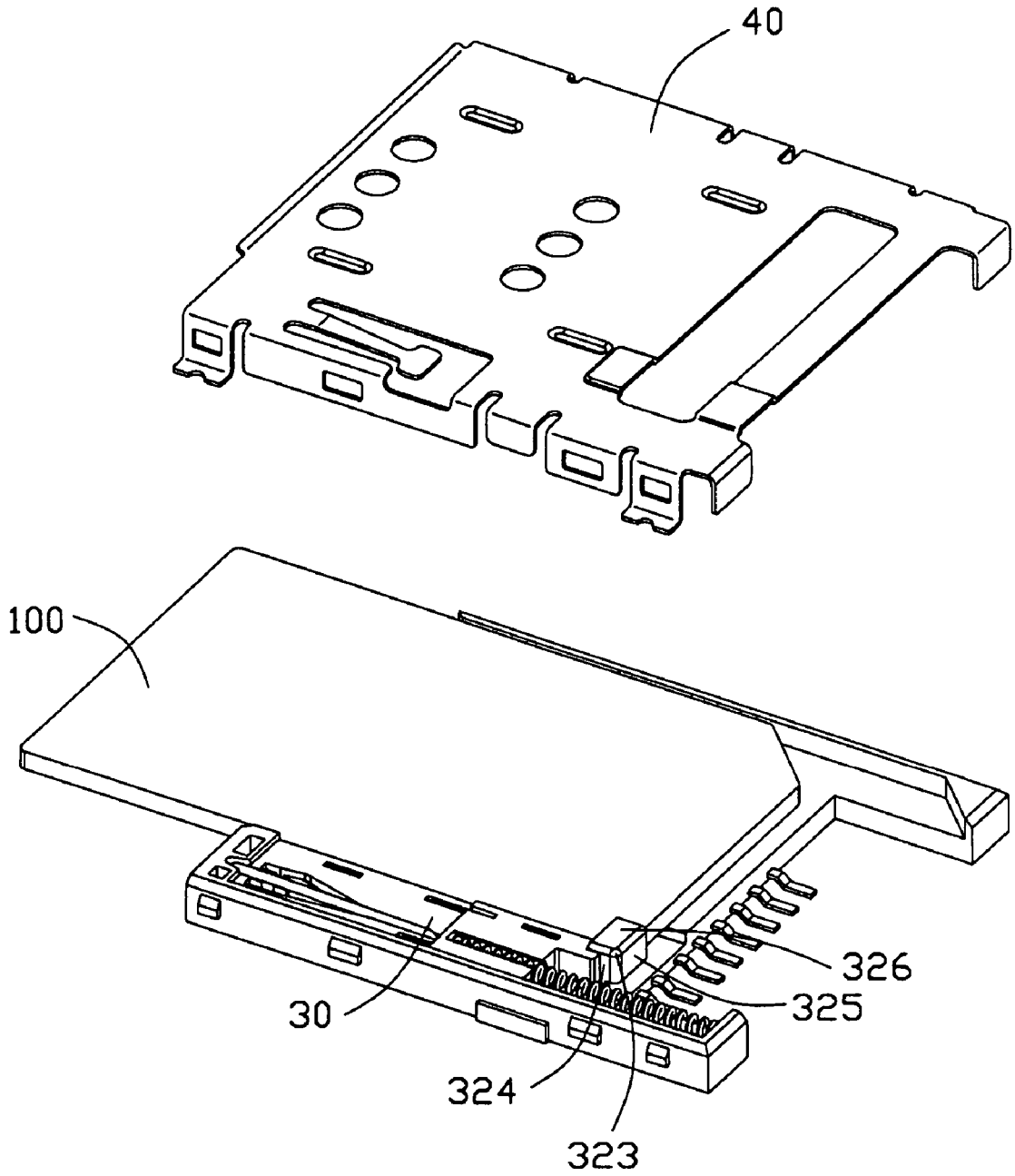
FIG. 5 is another partially exploded, perspective view of the card connector in accordance with the present invention, with the electrical card inserted in the insulting housing.

When ejecting the SIM card 100, a rearward push force is exerted to the SIM card 100 to make the pin member 33 move along the heart-shaped slot 312 again so as to release the slider 31 from the final position. At this time, the resilient restorable force of the spring 34 urges the slider 31 to move along the card ejecting direction so as to eject the SIM card 100 out of the card connector in virtue of the ejecting arm 32 of ejector 30 pushing the SIM card 100.

referring to FIG. 5, during the SIM card 100 inserting into the card connector, the rear corner of the SIM card 100 adjacent to the ejector 30 is received in the half exoteric space defined by the operating portion 323 of the ejecting arm 32 of the ejector 30, with the upright wall 324 adjacent to a sidewall of the SIM card 100, the blocking wall 325 contacting a rear surface of the SIM card 100 directly and the reinforce wall 326 upon the rear corner of the SIM card 100. Since the upright wall 324, the blocking wall 325 and the reinforce wall 326 are conjoined to each other and form into an integer body, the operating portion 323 has a high intensity of tension. The upright wall 324 and the reinforce wall 326 will partake in the force by the SIM card 100 exerting to the blocking wall 325, so the blocking wall 325 will not deform easily. Meanwhile, the reinforce wall 326 also can prevent the SIM card 100 from floating upwardly. Otherwise, the reinforce wall 326 may also be disposed at a bottom edge of the operating portion 323 and set below the SIM card 100.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector adapted for receiving a card, comprising:

an insulating housing defining a card receiving space with a card insertion/ejecting direction;

a plurality of contacts retained in the insulating housing;

an ejector received in the insulating housing and comprising a slider movable along the card insertion/ejecting direction, an ejecting aim protruding into the card receiving space, a resilient member urging the slider toward the card ejecting direction, the ejecting arm formed with an upright wall extending along the insertion/ejecting direction of the card, a blocking wall for contacting and ejecting the card directly and a horizontal reinforcing wall, the upright wall, the blocking wall and the reinforcing wall being linked with one another.

2. The card connector as described in claim 1, wherein the reinforcing wall is formed on a top edge of the ejecting arm and upon the card when the card inserted.

3. The card connector as described in claim 2, wherein the reinforcing wall is formed on a bottom edge of the ejecting arm and below the card when the card inserted.

4. The card connector as described in claim 1, wherein the ejecting arm of the ejector is stamped from a metal sheet and assembled to the slider, an operating portion is formed on an end of the ejecting arm away from the slider and protrudes into the card receiving space.

5. The card connector as described in claim 4, wherein the upright wall, the blocking wall and the reinforcing wall are formed on the operating portion.

6. The card connector as described in claim 5, wherein the upright wall abuts against a sidewall of the slider or set in the slider.

7. The card connector as described in claim 4, wherein the ejecting arm has a horizontal plate and an upright holding arm extending upward and rearward from the horizontal plate, the operating portion is on a rear end of the holding arm.

8. The card connector as described in claim 4, wherein the contacts comprise a plurality of signal contacts for electrically contacting with the card and at least one grounding contact electrically abuts against the ejecting arm.

9. The card connector as described in claim 8, wherein the insulating housing defines a receiving recess for accommodating the slider and a groove transversely communicating with a rear end of the receiving recess for positing the operating portion of the ejecting arm.

10. The card connector as described in claim 9, wherein the insulating housing defines an opening at a rear end thereof, and each contact has a soldering portion exposed in the opening and inwardly of the rear face of the insulating housing.

11. A card connector adapted for receiving a card, comprising:

an insulating housing defining a card receiving space with a card insertion/ejecting direction;

a plurality of contacts retained in the insulating housing;

an ejector received in the insulating housing and comprising a slider movable along the card insertion/ejecting direction, a metallic ejecting arm commonly movable with the slider and protruding into the card receiving space, and a resilient member urging the slider toward the card ejecting direction, wherein the ejection arm defines at least three walls perpendicular to one another to form a cubical space for receivably shielding a front corner of an inserted card.

12. A card connector assembly, comprising:

an insulating housing defining an upward card receiving space with a card insertion/ejecting direction;

a card received in said card receiving space;

a plurality of contacts retained in the insulating housing and comprising a slider movable along the card insertion/ejecting direction, a metallic ejecting arm commonly moveable with the slider and protruding into the card receiving space, and a resilient member urging the slider toward the card ejecting direction, wherein the ejecting arm defines at least an upper horizontal wall shielding an upper face of the card around a front corner thereof, and a vertical wall engaged with a front edge surface of the card around the front corner.

* * * * *